US010985447B2

(12) United States Patent
Ozden

(10) Patent No.: US 10,985,447 B2
(45) Date of Patent: Apr. 20, 2021

(54) ANTENNA DEVICE

(71) Applicant: GN HEARING A/S, Ballerup (DK)

(72) Inventor: Sinasi Ozden, Rodovre (DK)

(73) Assignee: GN Hearing A/S, Ballerup (DK)

( * ) Notice: Subject to any disclaimer, the term of this patent is extended or adjusted under 35 U.S.C. 154(b) by 74 days.

(21) Appl. No.: 16/241,309

(22) Filed: Jan. 7, 2019

(65) Prior Publication Data

US 2019/0157748 A1 May 23, 2019

Related U.S. Application Data

(63) Continuation of application No. 13/878,642, filed on Aug. 2, 2013, now Pat. No. 10,205,227.

(51) Int. Cl.
*H01Q 1/12* (2006.01)
*H01Q 1/27* (2006.01)
(Continued)

(52) U.S. Cl.
CPC ..... *H01Q 1/273* (2013.01); *H01Q 1/243* (2013.01); *H01Q 1/245* (2013.01); *H01Q 1/48* (2013.01);
(Continued)

(58) Field of Classification Search
CPC . H01Q 1/273; H01Q 9/40; H01Q 9/42; H04R 25/554; H04R 2225/51
See application file for complete search history.

(56) References Cited

U.S. PATENT DOCUMENTS 7,548,211 B2 * 6/2009 Platz ..... H01Q 1/085 343/702
7,570,777 B1 8/2009 Taenzer et al.
(Continued)

FOREIGN PATENT DOCUMENTS

CN 1669182 A 9/2005
CN 101330169 A 12/2008
(Continued)

OTHER PUBLICATIONS

Notification of Reason for Rejection dated Oct. 13, 2015 for corresponding Japanese Patent Application No. 2013-533192, 4 pages.
(Continued)

*Primary Examiner* — Amir H Etesam
(74) *Attorney, Agent, or Firm* — Vista IP Law Group, LLP

(57) ABSTRACT

An antenna device configured to be used at or in proximity to a user, the antenna device includes: an antenna structure having a conducting element, the conducting element extending over a length of between 1/16 of a wavelength and a full wavelength in a direction substantially orthogonal to a surface of the user, when the antenna device is provided in an intended operational position. A device includes: a housing having an operational position with respect to a user of the device; and an antenna structure coupled to the housing and having a conducting element, wherein the antenna structure is configured to emit an electromagnetic field so that the electromagnetic field propagates in a direction having a major directional vector that corresponds with a surface of a user using the device when the housing is at the operative position.

45 Claims, 10 Drawing Sheets

(51) Int. Cl.

| | |
|---|---|
| ***H04R 25/00*** | (2006.01) |
| ***H01Q 1/48*** | (2006.01) |
| ***H01Q 21/28*** | (2006.01) |
| ***H01Q 9/04*** | (2006.01) |
| ***H01Q 1/52*** | (2006.01) |
| ***H01Q 1/24*** | (2006.01) |
| ***H01Q 9/42*** | (2006.01) |
| ***H01Q 9/30*** | (2006.01) |

(52) U.S. Cl.

CPC ..... *H01Q 1/52* (2013.01); *H01Q 9/0421* (2013.01); *H01Q 9/30* (2013.01); *H01Q 9/42* (2013.01); *H01Q 21/28* (2013.01); *H04R 25/554* (2013.01); *H04R 25/558* (2013.01)

(56) References Cited

U.S. PATENT DOCUMENTS

| | | | | |
|---|---|---|---|---|
| 2005/0057414 | A1 | 3/2005 | Poilasne et al. | |
| 2005/0099341 | A1* | 5/2005 | Zhang | H01Q 1/38 343/700 MS |
| 2005/0128162 | A1 | 6/2005 | Takagi et al. | |
| 2005/0244024 | A1 | 11/2005 | Fischer et al. | |
| 2006/0018496 | A1 | 1/2006 | Niederdrank et al. | |
| 2006/0197706 | A1 | 9/2006 | Takei | |
| 2007/0080889 | A1 | 4/2007 | Zhang | |
| 2008/0095387 | A1 | 4/2008 | Niederdrank et al. | |
| 2009/0074216 | A1 | 3/2009 | Bradford et al. | |
| 2009/0243944 | A1 | 10/2009 | Jung et al. | |
| 2010/0020994 | A1 | 1/2010 | Christensen et al. | |
| 2010/0172525 | A1 | 7/2010 | Angst et al. | |
| 2011/0129094 | A1 | 6/2011 | Petersen | |
| 2011/0211714 | A1 | 9/2011 | Plath | |

FOREIGN PATENT DOCUMENTS

| | | | |
|---|---|---|---|
| CN | 101453048 | A | 6/2009 |
| DE | 102008022127 | | 11/2009 |
| EP | 1681903 | | 7/2006 |
| EP | 1 763 145 | | 3/2007 |
| EP | 2006953 | A1 | 12/2008 |
| EP | 2 193 767 | | 6/2010 |
| JP | 2005-518125 | | 6/2005 |
| JP | 2005-304038 | | 10/2005 |
| JP | 2009-033853 | | 2/2006 |
| JP | 2007-013247 | A | 1/2007 |
| WO | WO 96/41498 | | 12/1996 |
| WO | WO 03/069729 | A1 | 8/2003 |
| WO | WO 2004025778 | A1 | 3/2004 |
| WO | WO 2005/081583 | | 9/2005 |
| WO | WO 2006/018711 | | 2/2006 |
| WO | WO 2009/098858 | | 8/2009 |
| WO | WO 2009/117778 | | 10/2009 |
| WO | WO 2010/065356 | | 6/2010 |
| WO | WO 2010065356 | A1 | 6/2010 |

OTHER PUBLICATIONS

1st Danish Office Action dated Apr. 26, 2011 for DK Patent Application No. PA 2010 00931.

2nd Danish Office Action dated Apr. 24, 2012 for DK Patent Application No. PA 2010 00931.

3rd Danish Office Action dated Oct. 17, 2012 for DK Patent Application No. PA 2010 00931.

Extended European Search Report dated Nov. 18, 2011 for EP Patent Application No. 11174155.9.

Japanese Office Action dated Feb. 12, 2013 for JP Patent Application No. 2011-224711.

Novelty Search and Patentability Opinion Report dated Jul. 28, 2011, 8 pages.

International Search Report and Written Opinion dated May 15, 2013 for PCT Patent Application No. PCT/EP2011/067755, 12 pages.

First Office Action and Search Report dated May 6, 2014 in Chinese Patent Application No. 201180049547.5 (28 pages).

Non-Final Office Action dated Dec. 3, 2014 for related U.S. Appl. No. 13/878,642.

Gareth Conway, "Antennas for Over Body Surface Communication at 2.45 GHz", Apr. 2009.

Final Office Action dated Oct. 23, 2016 for related U.S. Appl. No. 13/878,642.

Advisory Action dated Mar. 22, 2016 for related U.S. Appl. No. 13/878,642.

Restriction Requirement dated Dec. 7, 2017 for related U.S. Appl. No. 13/878,642.

Non-Final Office Action dated May 31, 2018 for related U.S. Appl. No. 13/878,642.

Notice of Allowance and Fee(s) dated Oct. 2, 2018 for related U.S. Appl. No. 13/878,642.

* cited by examiner

ANTENNA DEVICE

RELATED APPLICATION DATA

This application is a continuation of U.S. patent application Ser. No. 13/878,642 filed Aug. 2, 2013, pending, which is the national stage of International Patent Application No. PCT/EP2011/067755, filed Oct. 12, 2013, which claims priority to and the benefit of Danish Patent Application No. PA 2010 00931, filed on Oct. 12, 2010, Danish Patent Application No. PA 2011 00272, filed on Apr. 7, 2011, Danish Patent Application No. PA 2011 00273, filed on Apr. 7, 2011, Danish Patent Application No. PA 2011 70392, filed on Jul. 15, 2011, Danish Patent Application No. PA 2011 70393, filed on Jul. 15, 2011, and European Patent Application No. EP 11174155.9, filed on Jul. 15, 2011. The disclosures of all of the above applications are expressly incorporated by reference herein.

FIELD

The present disclosure relates to the field of antennas, especially to antennas to be used at or in close proximity to a user body, such as antennas for providing wireless communication.

BACKGROUND

More and more electronic devices are used as provided on, in or in close proximity to a user and a user body. Typically, communication between these electronic devices or communication from these devices to devices provided externally from the user are provided for example using body area networks, wireless body area networks or wearable body area networks. The body area network field is being developed to for example allow inexpensive and continuous health monitoring. The monitoring may include real-time updates of medical records via the internet, and it may allow for early detection of medical conditions for example by implanting biosensors inside the human body to collect various physiological changes in order to monitor a patient's health status. Also other electronic devices provided at, in or in close proximity to a user, such as hearing aids provided in or behind the ear of a hearing impaired person, may communicate with externally provided electronic devices, such as hearing aid accessories. The body area networks are typically implemented using wireless standards, such as for example Bluetooth. However, use of the Bluetooth standard for communication requires a significant power source, typically not available in small biosensors, hearing aids, etc.

Furthermore, personal area networks providing exchange of digital information by capacitively coupling picoamp currents through the body for communication between electronic devices provided on or near the human body have been suggested.

Typically, however, significant losses are experienced during transfer of signals from an electronic device provided at or in close proximity to a user due to absorption of electromagnetic radiation by the human body. This may be overcome by increasing the power of the signals, however, this leads to an increased power consumption which is typically not desirable. Furthermore, for small electronic devices, such as wearable electronic devices, positioned at or in close proximity to the user, power sources are limited and an increased power consumption for transmitting wireless signals is not a viable solution.

SUMMARY

It is an object to overcome at least some of the disadvantages as mentioned above, and it is a further object to provide an antenna device specifically for being operated in close proximity to a user body.

In accordance with some embodiments, an antenna device configured to be used at or in close proximity to a user body is provided.

The antenna device comprises an antenna structure having a conducting element and the antenna structure may be configured so that a current is induced in at least the conducting element during operation. Preferably, the conducting element extends over a length of between 1/16 of a wavelength and a full wavelength in a direction substantially orthogonal to a surface of the user body, when the antenna device is provided in an intended operational position.

Hereby, an electromagnetic field emitted by the antenna structure during operation may have an electric field polarized substantially orthogonal to the surface of the user body and the electromagnetic field may propagate primarily in a direction along a surface of the user body.

The direction substantially orthogonal to a surface of the user body typically refers to a direction being substantially orthogonal to the surface of the user body in an area immediately surrounding the antenna device, when the antenna device is provided in an intended operational position at or in close proximity to the user. It is envisaged that in the present disclosure, the term user body encompasses the entire body including limbs, torso and head.

The antenna device may be provided at or in close proximity to the user in any way suitable for the use of the antenna device, and the antenna device may thus be configured to be carried by a user and the antenna device may be incorporated in a wearable electronic device, or it may be provided in connection with the wearable electronic device. The antenna device may also be provided as a "clip on" device, it may be configured to be carried in an armband, or a band for positioning around any other suitable body part. The antenna device may be provided on a user body using adhesive or being incorporated into the body using surgery. The antenna device may furthermore be provided in a necklace, a bracelet, a wrist watch, a pin or the like, or as a pendant to a necklace or a bracelet.

It is an advantage of providing such an antenna device that interconnection either in-between an electronic device provided at or in close proximity to a user, such as body sensors, such as for example continuous glucose sensors, medical devices, such as cardiac devices, etc., or wearable electronic devices, such as for example hearing aids, such as body area networks, such as for example a Body Area Network, BAN, or a wireless body area network, or WBAN, such as a wearable wireless body area network, or between an electronic device as mentioned above and provided at or in close proximity to a user and a body external transceiver or body external electronic device may be obtained. The body external transceiver or body external electronic device may be a processing unit and may be configured to be process the received signals providing an output for a user, or it may be connected to an operator, an alarm service, a health care provider, a doctors network, etc., either via the internet or any other intra- or interconnection between a number of computers or processing units, either continuously or upon request from either a user, an operator, a provider, or a system generated trigger. It is a further advantage that the antenna device may provide interconnection between one or more electronic devices provided at or in close proximity to the user body. The antenna device may connect to external electronic devices either directly, by providing an additional antenna in the antenna device, or via an intermediate antenna device.

The antenna device may be provided separately, or the antenna device may form part of an electronic device configured to operate in, at or in close proximity to a user. Preferably, the antenna structure comprises a resonant antenna structure.

The conducting element may preferably be structured so that upon excitation of the antenna structure, the current flows in at least the conducting element in a direction substantially orthogonal to the user body when antenna device is provided on or at the user in its operational position.

Hereby, upon excitation, a substantial part of the electromagnetic field, such as 60%, such as 80%, emitted by the antenna may propagate along the surface of the user body with its electrical field substantially orthogonal to the surface of the body of the user. That is orthogonal to the surface of the body of a user substantially at the position of the antenna device. When the electromagnetic field is diffracted along the surface of the user body, loses due to the interaction with the body surface are minimized. Hereby, a significantly improved reception of the electro-magnetic radiation by either a second electronic device provided on or in close proximity to the user, or by an external electronic device, may be obtained.

In that the electromagnetic field may be diffracted along the surface of the user body with minimum interaction with the surface of the user body, the strength of the electromagnetic field along the surface of the user body is significantly improved. Thus, the interaction with other antennas and/or transceivers, as provided in other electronic devices as mentioned above, may be enhanced.

The conducting element of the antenna structure may be connected to a transceiver and configured so that the conducting element conducts current of large amplitude at the desired transmission frequency of the electromagnetic field. Hereby, a major part of the power of the electromagnetic field emitted by the antenna and propagating from the antenna to another electronic device may be contributed by the conducting element. The length of the conducting element may be determined as the length of the current path in the conducting element. The length of the conducting element may be between one sixteenth wavelength and a full wavelength, such as between one sixteenth and three quarters wavelength, such as between one sixteenth and five eighths wavelength, such as between one sixteenth and a quarter wavelength, such as between one sixteenth and a half wavelength, such as between one sixteenth and three eighths wavelength, such as between one sixteenth and one eighths wavelength. It is envisaged that for some embodiments, it may be advantageous to use a lower limit on the length being one eighth wavelength. In a specifically preferred embodiment, the length of the conducting element is between one sixteenth wavelength and one eighth wavelength. The optimum length is selected based on a number of criteria including any size restraints and strength of the electromagnetic field.

The conducting element may be a first linear element, e.g. such as a rod-shaped element, which may be positioned so that the longitudinal direction of the conducting element is perpendicular to, or substantially perpendicular to, the surface of the body of a user proximate the intended operational position of the antenna device.

The first conducting element may form a ground plane and/or a reflecting plane for the antenna structure, thus the first conducting element may provide a common ground potential for the antenna structure.

The current flowing in a linear antenna forms standing waves along the length of the antenna; and for proper operation, a linear antenna is typically operated at, or approximately at, a resonance frequency at which the length of the linear antenna equals a quarter wavelength or any multiple thereof of the emitted electromagnetic field. Thus, the antenna structure comprising the first conducting element may have a length of a quarter wavelength or any multiple thereof of the emitted electromagnetic field.

The configuration of the conducting element, being positioned so that current flows in the conducting element in a direction orthogonal to, or substantially orthogonal to the user body, makes the antenna suitable for wireless communication between devices located at different positions of the body due to advantageous features of the emitted electromagnetic field as further explained below.

It is an advantage that, during operation, the conducting element of the antenna structure contributes to an electromagnetic field that travels along the surface of the user body thereby providing a wireless data communication that is robust and has low loss.

Due to the current component normal to the user body, such as normal to any body part on which the antenna device is provided, the surface wave of the electromagnetic field may be more efficiently excited.

The antenna structure may emit a substantially TM polarized electromagnetic field for diffraction along the surface of the body of a user, i.e. TM polarised with respect to the surface of the user body.

The antenna structure may not, or may substantially not, emit an electromagnetic field in the direction of the current path in the conducting element, and therefore the antenna structure does not, or substantially does not, emit an electromagnetic field in the direction orthogonal to the surface of the user body when the antenna device is positioned in its operational position at the body of the user; rather, the antenna structure emits an electromagnetic field that propagates in a direction parallel to the surface of the body of the user when the antenna device is positioned in its operational position during use, whereby the electric field of the emitted electromagnetic field has a direction that is orthogonal to, or substantially orthogonal to, the surface of the user body at least along the side of the body at which the antenna device is positioned during operation. In this way, propagation loss in the tissue of the body may be reduced as compared to propagation loss of an electromagnetic field with an electric field component being parallel to the surface of the user body. Diffraction around various body parts makes the electromagnetic field emitted by the antenna structure propagate from one electronic device to another electronic device located at or in close proximity to different body parts or to an externally provided electronic device.

When providing an antenna element configured to be worn adjacent a user body during operation, the size of the antenna device is an important parameter. Typically, the orientation of current paths of the antenna elements in wearable electronic devices has been determined in response to limitations imposed by the shape and small size of the electronic devices.

The antenna device may be configured to be operated at any frequency. Preferably, the antenna device is configured for operation at a frequency of at least 1 GHz, such as at a frequency between 1.5 GHz and 3 GHz such as at a frequency of 2.4 GHz.

The antenna device may preferably be accommodated within a housing, preferably so that the antenna structure is positioned inside the housing without protruding out of the housing.

In one embodiment, the conducting element may form a first section of an actively fed antenna structure, and the actively fed antenna structure may further comprise a second section.

It is an advantage of providing an antenna structure having first and second sections that typically, a linear antenna may have a current having a maximum amplitude proximate the root, or the excitation point, of the antenna. Thus, the part of the antenna proximate the excitation point of the antenna generally contributes significantly to the electromagnetic signal emitted from the antenna structure. Thus, having a first conducting element forming a first linear section of the antenna structure and which has a longitudinal direction that is orthogonal to the surface of the user body, when positioned in its desired operational position at the user body, the orientation of the remaining part of the antenna is less critical in order to obtain an electromagnetic field propagating primarily in a direction along a surface of the user body.

It is preferred to provide second and/or further section(s) for the antenna structure to obtain a preferred length for proper operation at the desired radio frequency, e.g. a length equal to, or approximately equal to, a quarter wavelength of the electromagnetic field or any multiple thereof.

The second section may be orthogonal to the first section, or the second section may comprise a meandering antenna element or an antenna shortening component to provide an antenna structure having a predetermined overall length, thus for example, the combined length of the first section and the second and/or further sections may be a quarter of a wavelength or any integer multiple thereof.

Thus, the first conducting element may be interconnected with a second section, and possibly further sections, of the antenna structure in order to obtain a combined length of the antenna appropriate for emission of the desired wavelength of the electromagnetic field.

The overall physical length of the antenna structure may be decreased by interconnecting the antenna with an electronic component, a so-called antenna shortening component, having an impedance that modifies the standing wave pattern of the antenna thereby changing its effective length. The required physical length of the antenna may for example be shortened by connecting the antenna in series with an inductor or in shunt with a capacitor.

Thus, the antenna may have a single linear section of a relative short length, such as one sixteenth of the emitted wavelength, positioned in the housing in such a way that its longitudinal direction is orthogonal to a user body when the antenna device is provided in its intended operational position at the user body. Preferably, the antenna structure forms a monopole antenna.

In another embodiment, an antenna device is provided wherein the antenna structure comprises a parasitic antenna element. The parasitic antenna element may be configured relative to the conducting element, so that a current is drawn in the conducting element in a direction orthogonal to the user body, when the antenna device is provided in the intended operational position.

The antenna structure may further comprise a first antenna element, and preferably, the first antenna element and the parasitic antenna element are provided separated by a predetermined distance, and the conducting element may be configured to interconnect the first antenna element and the parasitic antenna element. Preferably, the predetermined distance between the first side and the second side may be between 1/16 of a wavelength and a full wavelength.

The first antenna element may for example be a longitudinal antenna element extending parallel with the surface of a user body.

In one embodiment, the first antenna element may be provided along a first side of a housing and the parasitic antenna may be provided along a second side of the housing. The first side of the housing and the second side of the housing may be opposite sides, and the opposite first and second sides may be substantially parallel. The distance between the first side and the second side may be between 1/16 of a wavelength and a full wavelength.

The first antenna element may be an actively fed antenna element having an excitation point. The parasitic antenna element may be connected to the conducting element at a first position, the first position forming the excitation point for the parasitic antenna element. The first antenna element and the parasitic antenna element may be configured so that the excitation point for the first antenna is provided substantially opposite the first position along the conducting element. It is envisaged that a current may run from the first antenna excitation point to an excitation point for the conducting element and that this current may run in a direction different from a direction orthogonal to the surface of a user body. Preferably this current is negligible compared to the current in the conducting element. The current running in this different direction may be minimized by minimizing the distance between the excitation point for the first antenna and the excitation point for the conducting element, while still providing a sufficiently strong excitation for the first antenna element.

The combined length of the parasitic antenna element and the conducting element may equal a quarter of a wavelength or any multiple, or odd multiple, thereof. The length of the conducting element may be determined as an effective length of the conductive element, such as for example the shortest length along the conducting element between the first antenna element excitation point and the parasitic antenna element, i.e. the first position, such as for example the shortest current path between the excitation point of the first antenna and the first position.

The conducting element forming an electrical connection between the first antenna element and the parasitic antenna element may be any conducting material, such as for example a printed circuit board.

The shape of the parasitic antenna element may not be critical, and the parasitic antenna element may form a patch geometry, a rod geometry, a monopole geometry, a meander line geometry, etc. or any combination thereof.

Preferably, the current of the antenna structure comprising the conducting element and the parasitic antenna elements are configured so that the current has a maximum current amplitude at the conducting element.

In one embodiment, the first antenna element may excite at least a part of the conducting element and thereby also excite the parasitic antenna element having at least one electrical connection to the conducting element. Hereby, even if the conducting element does not comprise an antenna, but rather constitutes a ground plane for the parasitic antenna element, a current will be induced in the conducting element. Thus, the conducting element may form a ground plane for the antenna structure, wherein a current induced in the conducting element upon excitation of the first antenna element may flow.

The ground plane thus guides the current induced by the first antenna element. In a preferred embodiment, the excitation point for the parasitic antenna element is opposite to an excitation point for the first antenna element.

In a preferred embodiment, the first antenna element excitation point and the parasitic antenna element excitation point are provided separated by a distance along an axis substantially orthogonal to the body of a user, the distance preferably being between one sixteenth wavelength and a full wavelength, such as between one sixteenth and three quarters wavelength, such as between one sixteenth and five eighths wavelength, such as between one sixteenth and a half wavelength, such as between one sixteenth and three eighths wavelength, such as between one sixteenth and one eighth wavelength. It is envisaged that for some embodiments, it may be advantageous to use a lower limit on the length being one eighth wavelength. In a specifically preferred embodiment, the length of the conducting element is between one sixteenth wavelength and one eighth wavelength. The optimum length is selected based on a number of criteria including any size restraints and strength of the electromagnetic field.

Upon excitation, the induced current will flow in the conducting element from approximately the first antenna element excitation point to the parasitic antenna element excitation point in the direction orthogonal the surface of the user body in the point or area where on the antenna device is provided, and the current will excite the parasitic antenna element. Thus, for example for a behind-the-ear hearing aid, having a first antenna provided along one side of the hearing aid following the head of a user, and a parasitic antenna element provided along an opposite side of the hearing aid being interconnected with the first antenna via a conducting element, the current induced in the conducting element will primarily run parallel to an ear-to-ear axis of a user.

The parasitic antenna element excitation point is typically provided at the ground plane for the antenna element so that upon excitation of the first antenna element current flows in the conducting element in a direction which is substantially orthogonal to the surface of the user body when the antenna device is worn by a user in its intended operational position. It is envisaged that the first antenna element excitation point and the parasitic antenna element excitation point also may be provided along an axis forming a non-orthogonal angle to the surface of a user body, however at a trade-off regarding efficiency for the antenna device. In a preferred embodiment, the ground plane may be a printed circuit board connecting the first antenna element and the parasitic antenna element(s). In this case both the first antenna element excitation point and the parasitic antenna element excitation point may be provided at the printed circuit board. The ground potential plane may thus be a printed circuit board, but the ground potential plane may be formed in any material capable of conducting a current upon excitation of the antenna elements. The ground plane may also be formed as a single conducting path of e.g. copper, for guiding the current.

The length of the conducting element is defined as the length of the current path from the primary antenna element excitation point to the parasitic antenna element excitation point.

It is an advantage of providing a parasitic element that the bandwidth for the antenna system may be increased significantly, compared to an antenna system where no parasitic antenna element is provided. The bandwidth may be improved by a factor two, such that the bandwidth is doubled, compared to an antenna system having only a first antenna element and the first conducting element. In a preferred embodiment, the parasitic antenna element is a mirror picture of the first antenna element, or the parasitic antenna element and the first antenna element may form symmetric antenna structures, e.g. so that the first antenna element forms a meandering antenna structure and the parasitic antenna element forms a corresponding meandering antenna structure, the parasitic and the first antenna element may also form identical antenna structures.

It is an advantage that the parasitic antenna element assist to further excite currents that run along the short dimension of the ground plane, such as along the conducting element to thereby further excite the surface wave of the electromagnetic radiation.

In an embodiment wherein the conducting element has a sufficient length and conducts a high current relative to the total current flowing in the antenna structure at and proximate a maximum of the standing wave(s) formed by the current, the conducting element contributes significantly to the electromagnetic field emitted from the overall antenna structure. Thereby, the orientation of the parasitic antenna elements are rendered less important or unimportant since these other elements do not contribute significantly to the electromagnetic field emitted from the antenna.

Typically, when providing an antenna element in a housing, such as an antenna element provided in a housing for a medical device, such as in a housing for a hearing aid, the desirable positioning and shape of the antenna element and other components in the housing are determined by the shape of the housing.

For example, both a second section of the antenna structure as described in one embodiment herein and/or a second or possible further sections of the parasitic antenna element as described in another embodiment, may be positioned so that current flows in the sections in directions in parallel to the surface of the user body when the antenna device is worn in its operational position at the desired position of the user. The parasitic antenna element preferably has a free end opposite the parasitic antenna element connection point, i.e. opposite the first position which is typically also the excitation point for the parasitic antenna element.

The antenna device may comprise further parasitic antenna elements in order to obtain a desired directional pattern of the emitted electromagnetic field and possibly a desired polarization.

Thus, the orientation of current paths of the parasitic antenna element may be determined in response to limitations imposed by the shape and small size of an electronic device incorporating the antenna device and the desirable positioning and shape of other components in the housing. For example, second and possible further sections of the parasitic antenna element may be positioned so that current flows in the sections in directions in parallel to the surface of the user body when the antenna device is worn or positioned in its intended operational position, such as for a hearing aid, at the ear of the user.

The antenna device may comprise further parasitic antenna elements in order to obtain a desired directional pattern of the emitted electromagnetic field and possibly a desired polarization.

The conducting element may have an excitation point, so that the conducting element may be fed from an electronic circuit in the hearing aid, that is be actively excited, or alternatively, the conducting element may be passively excited. The conducting element and the first antenna element may have a common excitation/feeding point. Typically, the excitation point of an antenna element is a point connected to a ground potential, such as a zero potential or a relative ground potential. The first antenna may be fed at or in close proximity to a longitudinal side of the ground plane, such as at the longitudinal side of a rectangular ground plane, which in turn may cause the current to run primarily along the shortest dimension of the ground plane, normal to the side of the user body, or normal to the body part to which the antenna device is attached.

The specific positioning of the first antenna element and the conducting element and possibly one or more parasitic antenna elements may be determined by the shape of the electronic device in which the antenna device is to be incorporated, such as the shape of a hearing aid.

For example behind-the-ear hearing aid housings typically accommodate first antenna elements positioned with their longitudinal direction in parallel to the longitudinal direction of the banana shaped behind-the-ear hearing aid housing on one side of the hearing aid, while in-the-ear hearing aids typically have been provided with patch antennas positioned on the face plate of the hearing aids.

In an embodiment, the housing is a behind-the-ear housing configured to be positioned behind the ear of the user during use and the first antenna element is provided on a first longitudinal side of the hearing aid assembly, and the parasitic antenna element(s) are provided on a second longitudinal side of the hearing aid assembly. The first antenna element and the parasitic antenna element may be connected via a conducting element, such as a conducting element provided as a printed circuit board, such as a supporting element comprising an antenna, etc., and/or the conducting element may constitute a ground plane for the antenna elements.

The hearing aid antenna comprising the parasitic antenna element, the first section and the primary antenna element may be configured for operation in the ISM frequency band. Preferably, the antennas are configured for operation at a frequency of at least 1 GHz, such as at a frequency between 1.5 GHz and 3 GHz such as at a frequency of 2.4 GHz.

In some embodiments, a hearing aid system may be provided, the hearing aid system comprising a hearing aid and an antenna device according to any of the above described antenna devices.

The hearing aid system may further comprise one or more hearing aid accessories, wherein at least one of the hearing aid accessories comprises an accessory antenna device according to any of the above described antenna devices. The at least one hearing aid accessory may be configured to be provided at or in close proximity to a user body and configured to communicate with the hearing aid antenna device. The at least one hearing aid accessory may for example be a remote control, and the remote control and the accessory antenna device may be provided in the form of a wearable electronic device, such as for example in the form of a wrist watch, or wrist band.

The wearable electronic device may further comprise an external antenna configured to communicate with one or more external electronic devices, such as other hearing aid accessories, hearing aid configuration software, testing software, etc.

In one embodiment of the hearing aid system, communication between the one or more external electronic devices, such as hearing aid accessories, and the hearing aid, may be performed via the wearable electronic device.

In some embodiments, a hearing aid comprising a hearing aid antenna configured for communication with an antenna device according to any of the above-described antenna devices is provided. The hearing aid antenna may have a conducting element being parallel to an ear-to-ear axis of a user when the hearing aid is worn in the intended operational position. The conducting element may thus protrude away from the surface of the head. Preferably, the conducting element is between 1/16 of a wavelength and a quarter of a wavelength.

The hearing aid and the hearing aid antenna may be provided within a housing, preferably so that the antenna structure is comprised within the housing and do not protrude outside of the housing.

The hearing aid antenna device may be configured for operation in the ISM frequency band, and preferably, the hearing aid antenna is configured for operation at a frequency of at least 1 GHz, such as at a frequency between 1.5 GHz and 3 GHz, such as in a frequency band centred around 2.4 GHz.

In some embodiments, an electronic device is provided, the electronic device comprising an antenna configured for communication with an antenna device as described herein above. The antenna may have a conducting element being orthogonal to a surface of a user body when provided in an operational position at or in proximity to a user body, the antenna being a quarter of a wavelength whereof the conducting element constitutes at least 1/16 of a wavelength.

An antenna device configured to be used at or in proximity to a user, the antenna device includes: an antenna structure having a conducting element, wherein the antenna structure is configured so that a current is induced in at least the conducting element during operation, the conducting element extending over a length of between 1/16 of a wavelength and a full wavelength in a direction substantially orthogonal to a surface of the user, when the antenna device is provided in an intended operational position.

Optionally, the antenna structure is configured to emit an electromagnetic field that (1) has an electric field polarized substantially orthogonal to the surface of the user, and (2) propagates primarily in a direction along the surface of the user.

Optionally, the conducting element forms a ground plane and/or a reflecting plane for the antenna structure.

Optionally, the antenna structure has a length that is a quarter of a wavelength.

Optionally, the antenna structure is configured to operate at a frequency that is at least 1 GHz.

Optionally, the antenna structure is accommodated in a housing.

Optionally, the conducting element forms a first section of an actively fed antenna structure, and wherein the actively fed antenna structure further comprises a second section.

Optionally, the second section is orthogonal to the first section.

Optionally, the second section comprises a meandering antenna element or an antenna shortening component.

Optionally, each of the first section and the second section has a length that is a quarter of a wavelength.

Optionally, the antenna structure forms a monopole antenna.

Optionally, the antenna structure is accommodated in a housing; wherein the antenna structure comprises a first antenna element along a first side of the housing, and a parasitic antenna element along a second side of the housing, the conducting element interconnecting the first antenna element and the parasitic antenna element.

Optionally, the first side of the housing and the second side of the housing are opposite sides, and wherein a distance between the first side and the second side of the housing is between 1/16 of a wavelength and a full wavelength.

Optionally, the parasitic antenna element is connected to the conducting element at a first position, and wherein the first antenna element is an actively fed antenna element having an excitation point substantially opposite the first position along the conducting element.

Optionally, a combined length of the parasitic antenna element and an effective length of the conducting element is a quarter of a wavelength.

Optionally, the conducting element comprises a printed circuit board.

Optionally, the antenna device is configured for communication with an electronic device positioned at or in proximity to the user.

Optionally, the antenna device is configured for communication with an external electronic device.

Optionally, the antenna device is configured to provide communication between an electronic device carried by the user and an external electronic device.

A hearing aid system includes: a hearing aid; and the antenna device.

A hearing aid system, includes: a hearing aid having a hearing aid antenna; and one or more hearing aid accessories, wherein at least one of the hearing aid accessories comprises the antenna device, and is configured to communicate with the hearing aid antenna.

Optionally, the at least one of the hearing aid accessories is a remote control, and wherein the remote control and the antenna device is in a form of a wearable electronic device.

Optionally, the wearable electronic device is configured to communicate with one or more external electronic devices.

Optionally, the wearable electronic device is configured to provide communication between the one or more external electronic devices and the hearing aid.

Optionally, the remote control and the accessory antenna device are parts of a wrist watch.

A hearing aid comprising a hearing aid antenna configured for communication with the antenna device, the hearing aid antenna having a conducting element oriented in a direction that corresponds with an ear-to-ear axis of a user of the hearing aid, the conducting element of the hearing aid being between 1/16 of a wavelength and a quarter of a wavelength.

Optionally, the hearing aid and the hearing aid antenna is in a housing.

Optionally, an operating frequency of the hearing aid antenna is at least 1 GHz.

An electronic device comprising an antenna configured for communication with the antenna device, the antenna having a conducting element being orthogonal to a surface of the user when provided in an operational position at or in proximity to the user, the antenna being a quarter of a wavelength, wherein the conducting element of the antenna constitutes between 1/16 of a wavelength and a quarter of a wavelength.

A method performed by an antenna device, includes: receiving a signal; and in response to the signal, emitting an electromagnetic field so that the electromagnetic field propagates in a direction having a major directional vector that corresponds with a surface of a user using the antenna device.

Optionally, the major directional component of the electromagnetic field is parallel to the surface of the user.

Optionally, the electromagnetic field is emitted by the antenna device, the antenna device having a conducting element extending over a length of between 1/16 of a wavelength and a full wavelength.

Optionally, the conducting element of the antenna device extends in a direction substantially orthogonal to the surface of the user.

Optionally, the emitted electromagnetic field has an electric field polarized substantially orthogonal to the surface of the user.

A device includes: a housing having an operational position with respect to a user of the device; and an antenna structure coupled to the housing and having a conducting element, wherein the antenna structure is configured to emit an electromagnetic field so that the electromagnetic field propagates in a direction having a major directional vector that corresponds with a surface of a user using the device when the housing is at the operative position.

Optionally, the conducting element extends over a length of between 1/16 of a wavelength and a full wavelength.

Optionally, the conducting element extends in the direction that is substantially orthogonal to the surface of the user when the housing is at the operative position.

Optionally, the antenna structure is configured to emit the electromagnetic field having an electric field polarized substantially orthogonal to the surface of the user.

Optionally, the conducting element forms a ground plane and/or a reflecting plane for the antenna structure.

Optionally, the antenna structure has a length that is a quarter of a wavelength.

Optionally, the antenna structure is configured to operate at a frequency that is at least 1 GHz.

Optionally, the conducting element forms a first section of an actively fed antenna structure, and wherein the actively fed antenna structure further comprises a second section.

Optionally, the second section is orthogonal to the first section.

Optionally, the second section comprises a meandering antenna element or an antenna shortening component.

Optionally, each of the first section and the second section has a length that is a quarter of a wavelength.

Optionally, the antenna structure forms a monopole antenna.

Optionally, the antenna structure comprises a first antenna element along a first side of the housing, and a parasitic antenna element along a second side of the housing, the conducting element interconnecting the first antenna element and the parasitic antenna element.

Optionally, the first side of the housing and the second side of the housing are opposite sides, and wherein a distance between the first side and the second side of the housing is between 1/16 of a wavelength and a full wavelength.

Optionally, the parasitic antenna element is connected to the conducting element at a first position, and wherein the first antenna element is an actively fed antenna element having an excitation point substantially opposite the first position along the conducting element.

Optionally, the conducting element comprises a printed circuit board.

It is envisaged that features and elements described in relation to one embodiment may equally apply to other embodiments if applicable.

The above and other features and advantages will become more apparent to those of ordinary skill in the art by describing in detail exemplary embodiments thereof with reference to the attached drawings in which:

DETAILED DESCRIPTION

Figure 1:
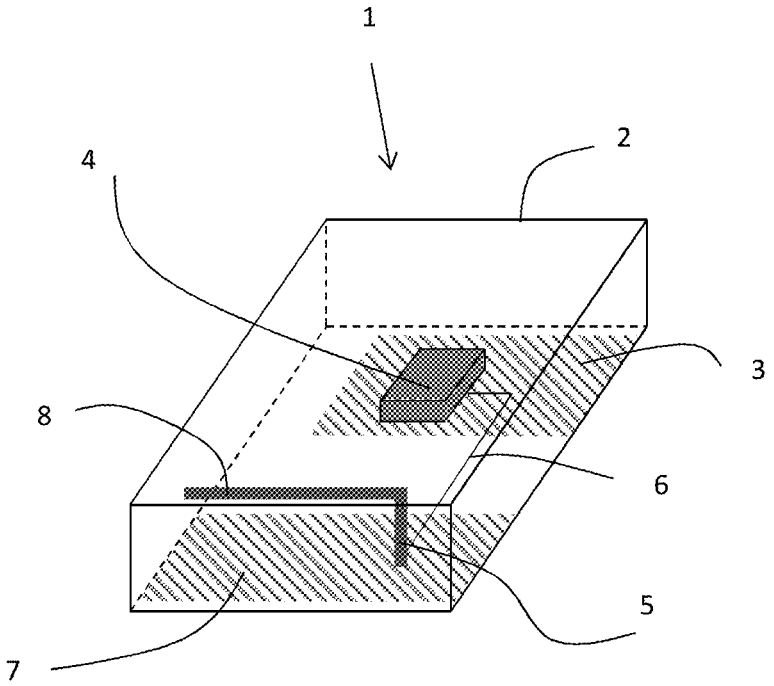
FIG. 1 shows an antenna device according to an embodiment.

Various features are described hereinafter with reference to the figures. It should be noted that the figures may or may not be drawn to scale and that the elements of similar structures or functions are represented by like reference numerals throughout the figures. It should be noted that the figures are only intended to facilitate the description of the features. They are not intended as an exhaustive description of the claimed invention or as a limitation on the scope of the claimed invention. In addition, an illustrated feature needs not have all the aspects or advantages shown. An aspect or an advantage described in conjunction with a particular feature is not necessarily limited to that feature and can be practiced in any other features even if not so illustrated.

In the following, a parallel antenna or a parallel section of an antenna designates an antenna or a section of an antenna, respectively, in a device that is worn at the body of a user during use and that conducts current mainly in directions parallel to the surface of the body at the position of the antenna, an orthogonal antenna or an orthogonal section of an antenna designates an antenna or a section of an antenna, respectively, in a device that is worn at the body of a user during use and that, at least in a section of the antenna, conducts current in a direction that is orthogonal to the surface of the body at the position of the antenna.

For example, a parallel antenna or a parallel section of an antenna, respectively, in a device that is worn at the ear of a user during use conducts current mainly in directions parallel to the surface of the head at the ear of the user, or in other words perpendicular to the ear to ear axis of the user, and an orthogonal antenna or an orthogonal section of an antenna designates an antenna or a section of an antenna, respectively, in a device that is worn at the ear of a user during use and that, at least in a section of the antenna, conducts current in a direction that is orthogonal to the surface of the head at the ear of the user, or in other words parallel to the ear to ear axis of the user.

The radiation pattern of an antenna is typically illustrated by polar plots of radiated power in horizontal and vertical planes in the far field of the antenna. The plotted variable may be the field strength, the power per unit solid angle, or directive gain. The peak radiation occurs in the direction of maximum gain.

Figure 2:
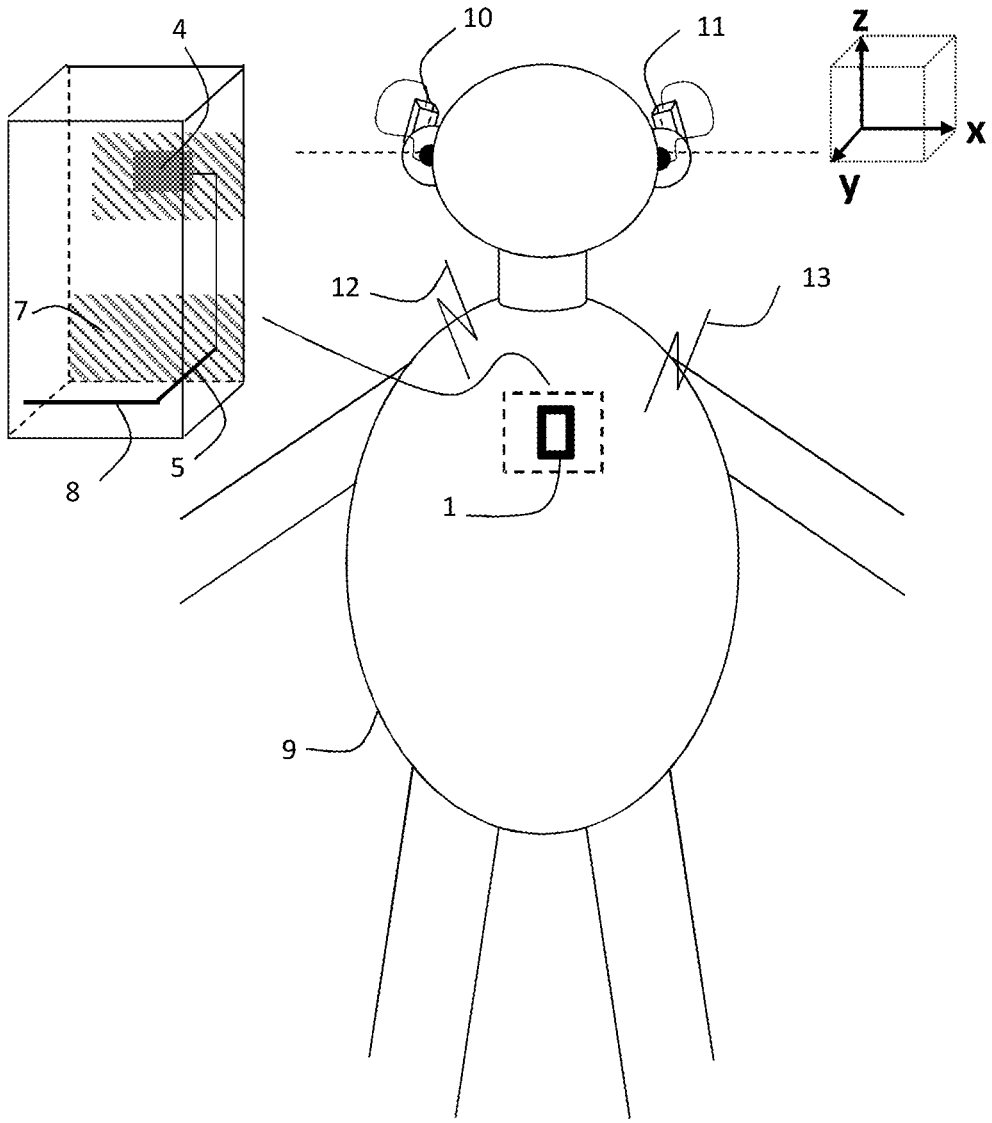
FIG. 2 shows a hearing aid configured to communicate with an antenna device positioned at the human body.

In FIG. 2, a model of a user is shown together with an ordinary rectangular three dimensional coordinate system with an x, y and z axis for defining orientations with relation to the user body.

Every point of the surface of the user body has a normal and a tangential vector. The normal vector is orthogonal to the surface of the user body while the tangential vector is parallel to the surface of the user body. An element extending along the surface of the user body is said to be parallel to the surface of the user body while an object extending from a point on the surface of the user body and radially outward from the user body into the surrounding space is said to be orthogonal to the head.

The user body model of FIG. 2 is standing erect on the ground (not shown in the figure), and the ground plane is parallel to the xy-plane. The torso axis from top to toe of the user is thus parallel to the z-axis, whereas the nose of the user is pointing out of the paper along the y-axis.

The axis going through the right ear canal and the left ear canal is parallel to the x-axis in the figure. This ear to ear axis (ear axis) is thus orthogonal to the surface of the head at the points where it leaves the surface of the head. The ear to ear axis as well as the surface of the user body or the head will in the following be used as reference when describing specific configurations of the elements of the embodiments.

Considering a device to be positioned at the ear of a user, such as a hearing aid, generally, since the auricle of the ear is primarily located in the plane parallel to the surface of the head on most test persons, it is often described that the ear to ear axis also functions as the normal to the ear. Even though there will be variations from person to person as to how the plane of the auricle is oriented.

The specific wavelength, and thus the frequency of the emitted electromagnetic field, is of importance when considering communication involving an obstacle. In one or more embodiments described herein, the obstacle is a user body, such as for example a head with a hearing aid comprising an antenna, the hearing aid being located close to the surface of the head. If the wavelength is too long such as a frequency of 1 GHz and down to lower frequencies greater parts of the user body will be located in the near field region. This results in a different diffraction making it more difficult for the electromagnetic field to travel around or along the user body. If on the other hand the wavelength is too short, the user body will appear as being too large an obstacle which also makes it difficult for electromagnetic waves to travel around or along a user body. Generally, communication is performed at frequencies larger than 1 GHz, such as at frequencies between 1.5 GHz and 3 GHz, preferably, the frequency band for industry, science and medical devices with a desired frequency centred around 2.4 GHz is selected.

In FIG. 1, an antenna device according to an embodiment is shown. The antenna device 1 has a housing 2 wherein the antenna structure is provided. The antenna structure has a conducting element 5 being substantially orthogonal to a supporting member 7. The supporting member 7 is configured to be provided at a user body so that the conducting element 5 is substantially orthogonal to the user body when the antenna device is provided in its intended operational position.

Typically, a resonant antenna, such as a rod-shaped antenna, needs to have a length approximately equal to a quarter of the wavelength of the emitted electromagnetic field at the desired radio frequency for the antenna.

Conventionally, orthogonal rod-shaped antennas have been too long to be accommodated inside an antenna device housing configured to be provided at or in close proximity to a user body, such as e.g. a hearing aid housing, with no parts protruding from the housing.

It has surprisingly been found that only a part of the antenna structure needs to be provided orthogonal to the body surface, and the conducting element 5 forming a first section of the antenna structure is preferably at least 1/16 of a wavelength. The second antenna element 8 may form a second section of the antenna structure, and may be another conducting element 8. It is envisaged that the second section of the antenna structure may have one or more bends without deteriorating its performance significantly, provided that the first section contributes significantly to the part of the emitted electromagnetic field.

The antenna structure 5, 8 is provided on a supporting structure 7 being a printed circuit board. In the present embodiment, the supporting structure 7 also forms a ground plane for the antenna. The antenna 5, 8 is connected to a central processing unit 4 via a transmission line 6. The transmission line 6 feeds the antenna structure 5, 8. The central processing unit may comprise a transceiver and may be provided on a same or a separate printed circuit board 3.

In FIG. 2, a user body 9 is shown schematically. The user is wearing a hearing aid 10, 11 at each ear. The hearing aids 10, 11 communicate with an antenna device 1 as provided at the chest of a user. The antenna device may communicate with the hearing aid 10 behind the right ear of the user via connection 12 and communicate with the hearing aid 11 behind the left ear of the user via the connection 13. It is envisaged that also the hearing aids 10, 11 comprises an antenna device according to some embodiments, and the hearing aids 10, 11 may furthermore communicate wirelessly with each other.

Figure 3:
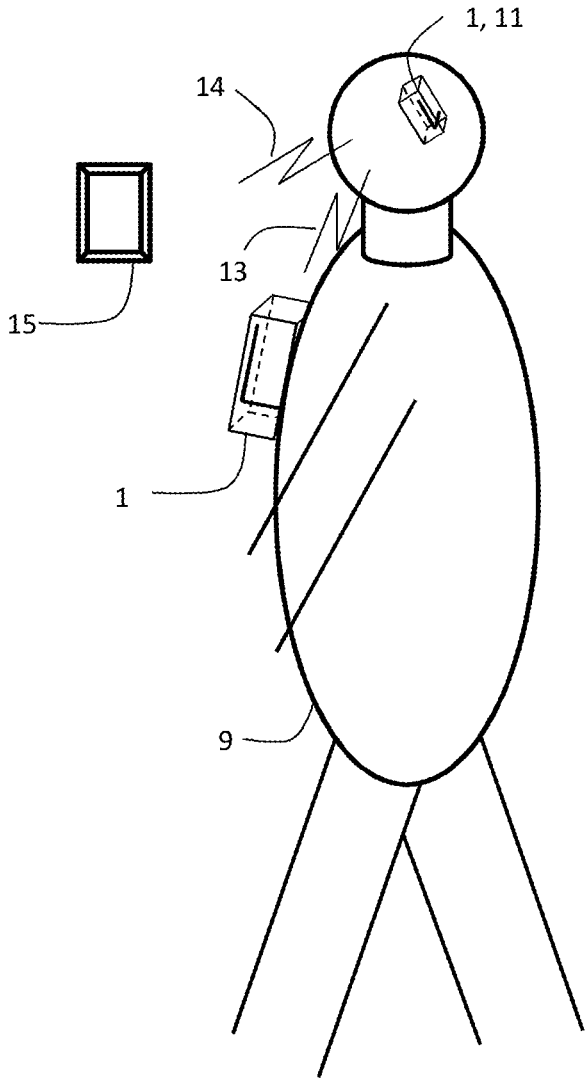
FIG. 3 shows a hearing aid with an antenna device configured to communicate with another antenna device.

FIG. 3 shows another embodiment, wherein a hearing aid 10 comprising an antenna device 1, as shown in detail in FIG. 1 communicates with the antenna device 1 as provided on the chest of the user via connection 13 and possibly also with an external electronic device 15 as provided external to the user body 9. The antenna device 1 as provided on the chest of a user may further comprise an electronic device, such as for example an electronic device for controlling hearing aid parameters.

Figure 4:
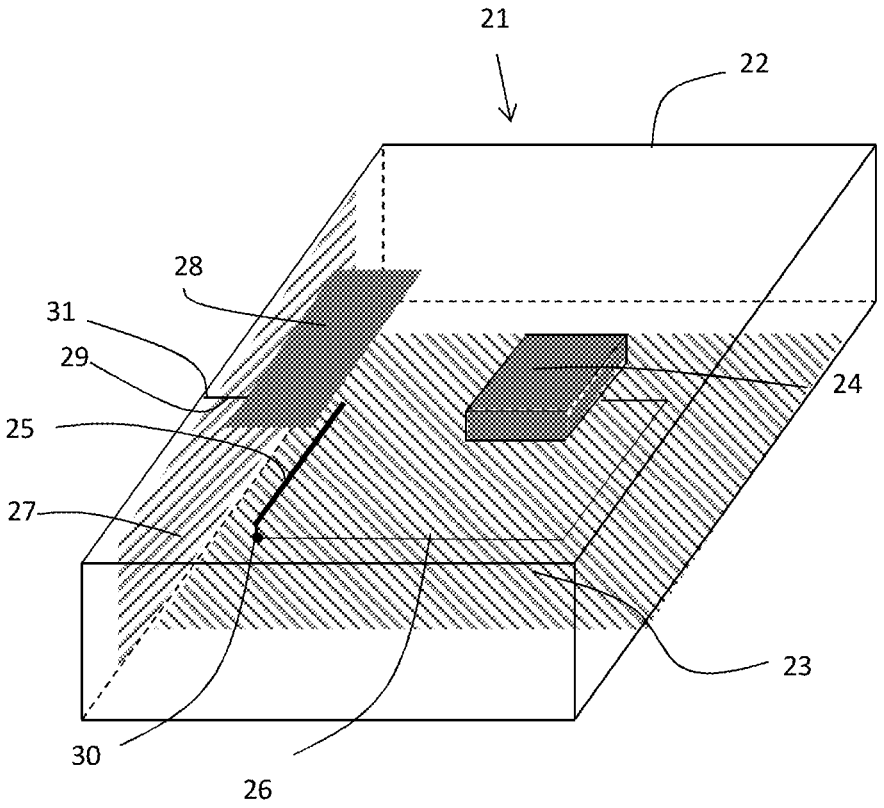
FIG. 4 shows an antenna device according to another embodiment.

FIG. 4 shows another embodiment of an antenna device 21. The antenna device is provided in a housing 22. The first antenna element 25 is a rod-shaped antenna element being provided elevated from the supporting structure 23. The supporting structure is intended to be provided along a user body when the antenna device is provided in its intended operational position. The supporting structure 23 is a printed circuit board and the transmission line 26 connects the first antenna element 25 to the central processing unit 24. A parasitic antenna element is provided opposite the first antenna element 25 in a direction orthogonal to the intended operational position of the antenna device 21. A conducting element 27 is provided interconnecting the first antenna element 25 and the parasitic antenna element 28. Upon excitation of the first antenna element 25, a current will flow in the conducting element 27 and excite the parasitic antenna element 28 via transmission line 29. In that the excitation point 30 for the first antenna element 25 is provided substantially across from the excitation point 31 for the parasitic antenna element along the conducting element 27, the current flowing in the conducting element 27 will have a direction substantially orthogonal to the supporting structure 23, and thus to the user body 9, when the antenna device 21 is provided in the intended operational position at the user body 9.

Figure 5:
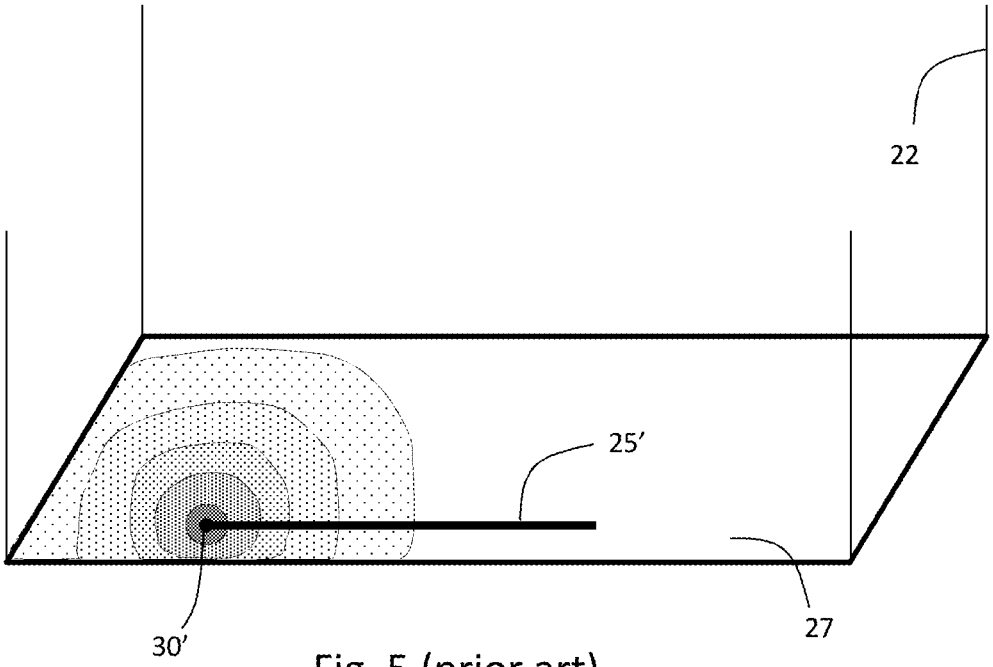
Fig. 5 (prior art)
FIG. 5 shows the current distribution for a prior art antenna.
Figure 6:
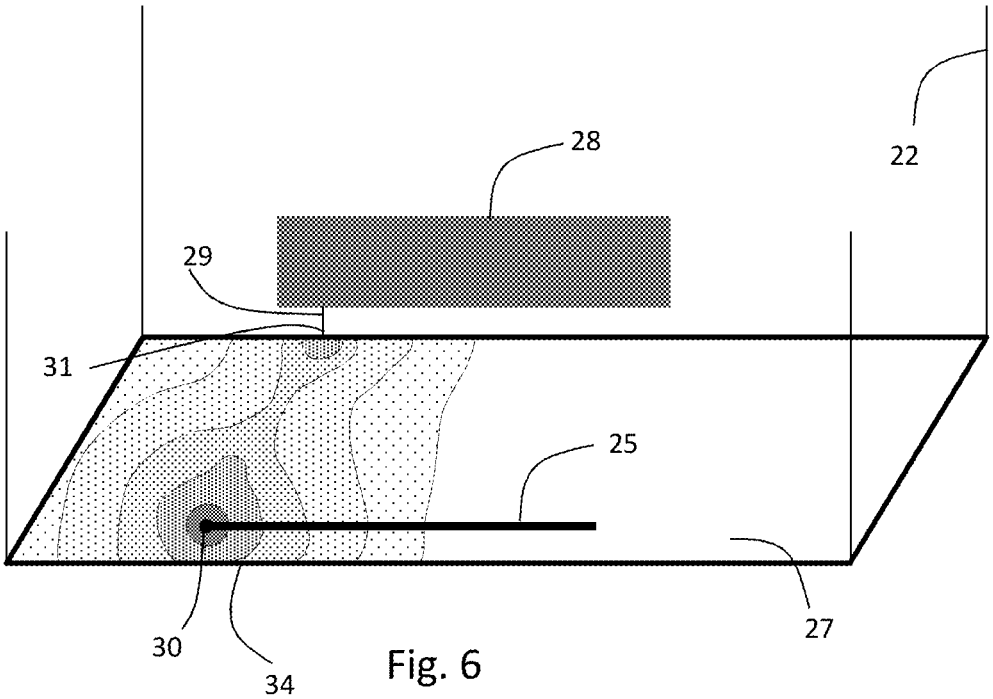
FIG. 6 shows the current distribution for an antenna design.

In FIG. 5 the current distribution in the conducting element 27 for a prior art embodiment wherein no parasitic antenna element is provided is shown for comparison. It is seen that the current intensity is largest immediately surrounding the antenna element excitation point. In FIG. 6, the current distribution for an antenna element 27 is shown in the presence of a parasitic antenna element 28. It is seen that the current flows across the conducting element 27 from the first antenna element excitation point 30 towards the parasitic antenna element excitation point 31. It is envisaged that the distance between the first antenna element excitation point 30 and the edge 34 of the conducting element 27 is kept as small as possible while ensuring an efficient excitation for the first antenna element 27.

Figure 7:
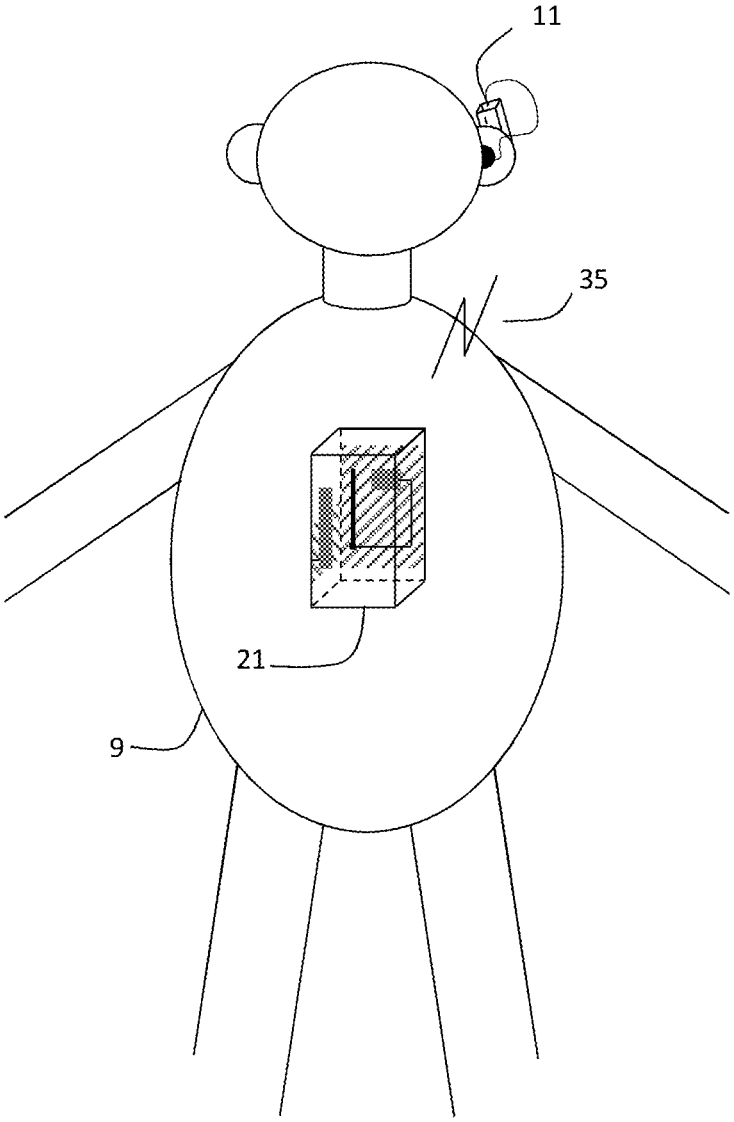
FIG. 7 shows an antenna device as shown in FIG. 4, configured to communicate with a hearing aid.

FIG. 7 shows a use of an antenna device as provided in FIG. 4, wherein a hearing aid 10 communicates with an antenna device 21 provided on the chest of a user body 9 via wireless connection 35.

Figure 8:
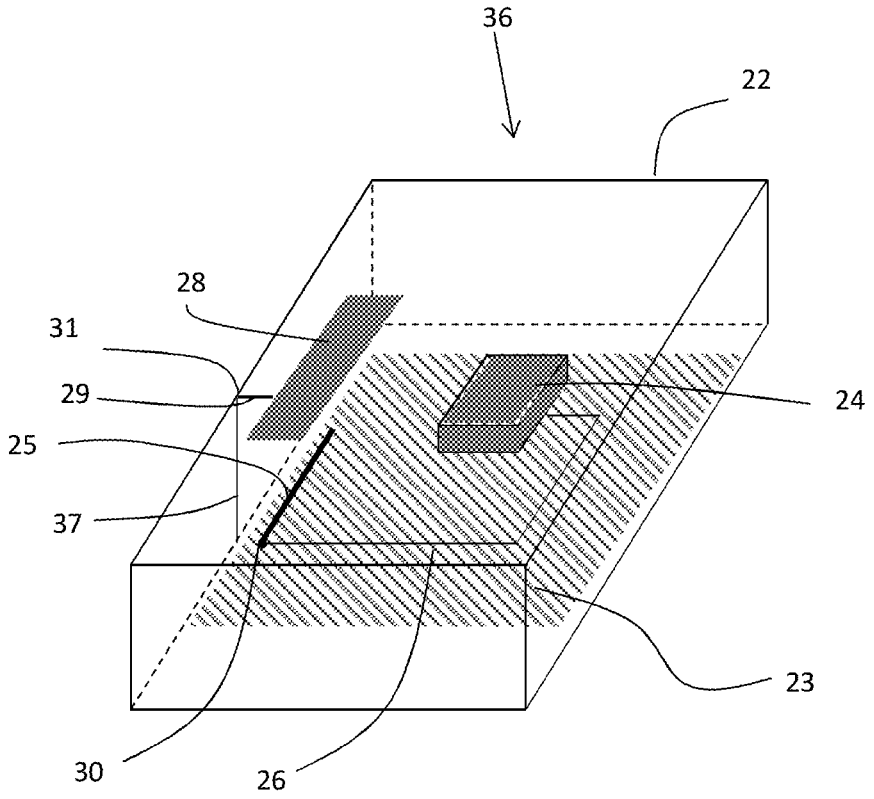
FIG. 8 shows another antenna device.

In FIG. 8, an antenna device 36 according to a further embodiment is shown. In this embodiment, the conducting element 37 is provided as a single conducting path of e.g. copper, for guiding the current. The further elements correspond to the elements as described in relation to FIG. 4.

Figure 9:
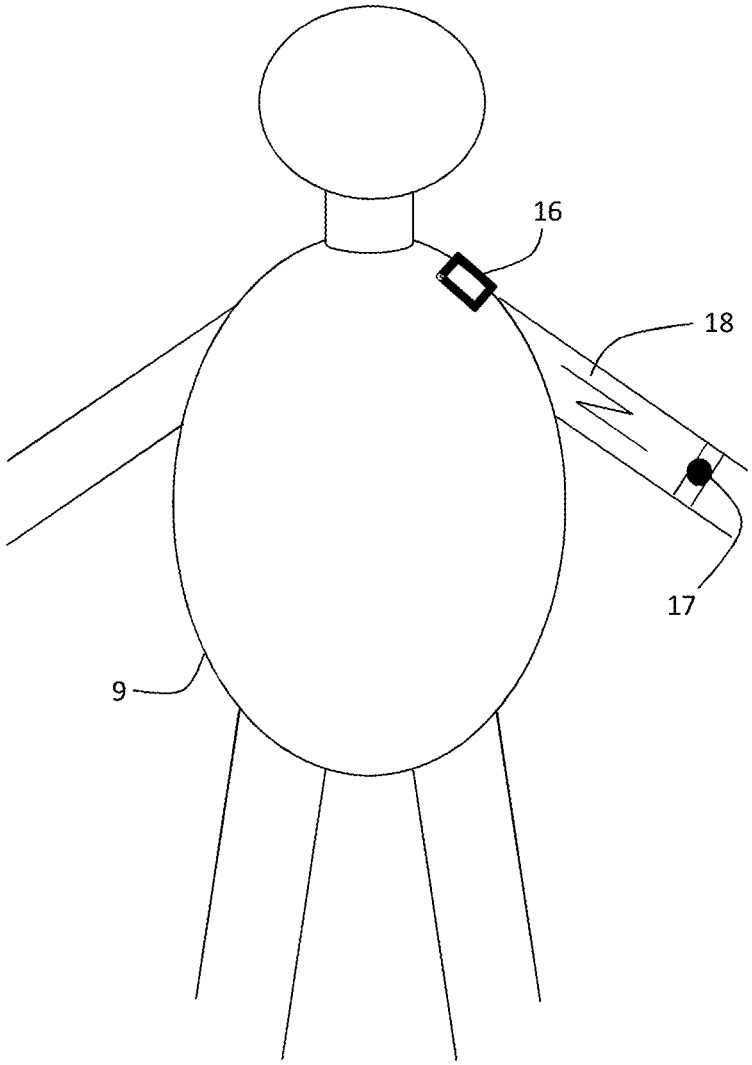
FIG. 9 shows a medical device positioned at the shoulder of a user, the medical device communicating with an antenna device as provided in a wrist watch.

In FIG. 9, another embodiment is shown wherein in a medical device, such as for example a biosensor or a device for measuring glucose content comprises an antenna device 1, 21, 36 according to any of the embodiments as herein described. The device 1, 21, 36 is provided on a surface of a user body 9, and communicates wirelessly 18 with a reception device 17, such as a reception device in the form of a wrist watch, for outputting medical device measurements, such as glucose values to a user.

Figure 10:
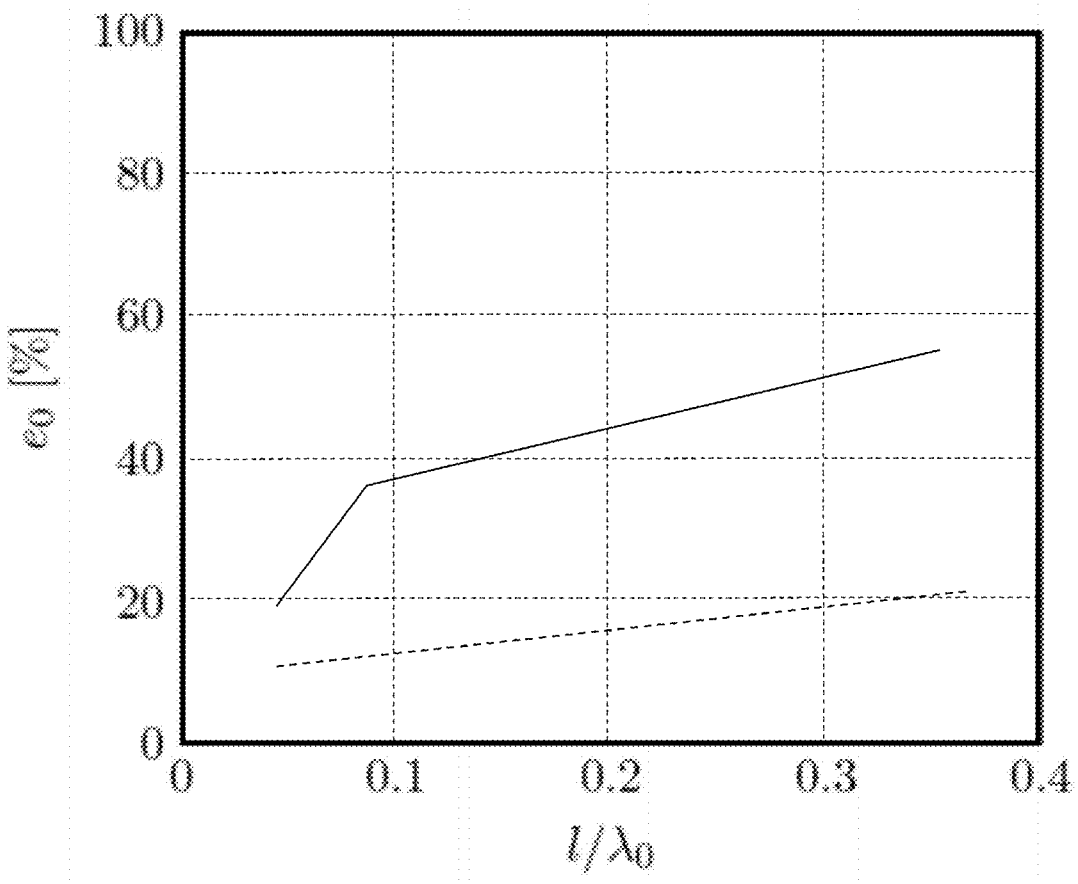
FIG. 10 shows the efficiency of coupling from a hearing aid on one side of the head to a hearing aid on the other side of the head, for an orthogonal and a parallel antenna, respectively as a function of antenna length.

In FIG. 10, total efficiencies of a parallel monopole rod antenna and an orthogonal monopole rod antenna with relation to path loss around the head of a human are compared as a function of physical antenna length. The resonance frequency of the antennas is kept the same by using a serial inductance. It should be noted that even the shortest orthogonal antenna is more effective in establishing an electromagnetic field at the opposite side of the head than the longest parallel antenna.

Although particular features have been shown and described, it will be understood that they are not intended to limit the claimed invention, and it will be made obvious to those skilled in the art that various changes and modifications may be made without departing from the spirit and scope of the claimed invention. The specification and drawings are, accordingly to be regarded in an illustrative rather than restrictive sense. The claimed invention is intended to cover all alternatives, modifications and equivalents.

The invention claimed is:

1. An apparatus comprising:

a housing having a surface for placement against a user of the apparatus;

a circuit in the housing; and an antenna coupled to the circuit, the antenna having a first segment and a second segment, the first segment coupled to transmit energy between the circuit and the second segment, wherein the first segment extends along a first direction having a first major directional component that is perpendicular to the surface of the housing, and wherein the second segment extends along a second direction having a second major directional component that is parallel to the surface of the housing;

wherein the antenna is configured to emit an electromagnetic field that (1) has an electric field polarized in a direction that is at an angle with respect to a surface of the user, and (2) has at least a majority propagating in a direction along the surface of the user.

2. The apparatus according to claim 1, further comprising a conducting element forming a ground plane and/or a reflecting plane.

3. The apparatus according to claim 1, wherein the first segment of the antenna has a length that is at least 1/16 of a wavelength.

4. The apparatus according to claim 1, wherein the antenna is configured to operate at a frequency that is at least 1 GHz.

5. The apparatus according to claim 1, further comprising an antenna shortening component coupled to the antenna.

6. The apparatus according to claim 1, further comprising a parasitic antenna element, and a conducting element connected to the parasitic antenna element.

7. The apparatus according to claim 6, wherein the parasitic antenna element is connected to the conducting element at a first position, and wherein the antenna has an excitation point opposite from the first position.

8. The apparatus according to claim 6, wherein a combined length of the parasitic antenna element and an effective length of the conducting element is a quarter of a wavelength.

9. The apparatus according to claim 1, further comprising a printed circuit board on which the circuit is coupled.

10. A hearing aid system comprising:

a hearing aid; and the apparatus according to claim 1.

11. A hearing aid system, comprising:

a hearing aid having a hearing aid antenna; and one or more hearing aid accessories, wherein at least one of the hearing aid accessories comprises the apparatus of claim 1, and is configured to communicate with the hearing aid antenna.

12. The apparatus according to claim 1, wherein the apparatus is configured to provide a remote control feature.

13. The apparatus according to claim 1, wherein the antenna is configured to provide communication between one or more external electronic devices and a hearing aid.

14. The apparatus according to claim 1, wherein the apparatus is a wrist watch.

15. The apparatus according to claim 1, wherein the apparatus is a hearing aid.

16. The apparatus according to claim 1, wherein the apparatus is configured to communicate with a hearing aid.

17. The apparatus according to claim 1, wherein a combined length of the first and second segments of the antenna is a quarter of a wavelength or larger.

18. The apparatus according to claim 1, further comprising an elongated member for wear around a neck of the user.

19. The apparatus according to claim 18, wherein when the user wears the elongated member around the neck, the housing rests against a body of the user.

20. The apparatus according to claim 1, wherein the surface is a major surface of the housing.

21. The apparatus according to claim 1, wherein the second segment has an end that is free of electrical connection to its surrounding.

22. The apparatus according to claim 1, wherein the apparatus is a hearing aid, and wherein at least a part of the antenna is oriented in a direction that corresponds with an ear-to-ear axis of the user.

23. The apparatus according to claim 1, wherein the electric field is polarized in the direction such that a propagation loss in tissue of the user is less than a certain level.

24. An apparatus comprising:

a housing;

a circuit board in the housing; and an antenna coupled to the circuit board, the antenna having a first segment and a second segment, the first segment coupled to transmit energy between the circuit board and the second segment, wherein the first segment extends along a first direction having a first major directional component that is perpendicular to a plane of the circuit board, and wherein the second segment extends along a second direction having a second major directional component that is parallel to the plane of the circuit board;

wherein the antenna is configured to emit an electromagnetic field that (1) has an electric field polarized in a direction that is at an angle with respect to a surface of the user, and (2) has at least a majority propagating in a direction along the surface of the user.

25. The apparatus according to claim 24, further comprising a conducting element forming a ground plane and/or a reflecting plane.

26. The apparatus according to claim 24, wherein the first segment of the antenna has a length that is at least 1/16 of a wavelength.

27. The apparatus according to claim 24, wherein the antenna is configured to operate at a frequency that is at least 1 GHz.

28. The apparatus according to claim 24, further comprising an antenna shortening component coupled to the antenna.

29. The apparatus according to claim 24, further comprising a parasitic antenna element, and a conducting element connected to the parasitic antenna element.

30. The apparatus according to claim 29, wherein the parasitic antenna element is connected to the conducting element at a first position, and wherein the antenna has an excitation point opposite from the first position.

31. The apparatus according to claim 29, wherein a combined length of the parasitic antenna element and an effective length of the conducting element is a quarter of a wavelength.

32. A hearing aid system comprising:

a hearing aid; and the apparatus according to claim 24.

33. A hearing aid system, comprising:

a hearing aid having a hearing aid antenna; and one or more hearing aid accessories, wherein at least one of the hearing aid accessories comprises the apparatus of claim 24, and is configured to communicate with the hearing aid antenna.

34. The apparatus according to claim 24, wherein the apparatus is configured to provide a remote control feature.

35. The apparatus according to claim 24, wherein the antenna is configured to provide communication between one or more external electronic devices and a hearing aid.

36. The apparatus according to claim 24, wherein the apparatus is a wrist watch.

37. The apparatus according to claim 24, wherein the apparatus is a hearing aid.

38. The apparatus according to claim 24, wherein the apparatus is configured to communicate with a hearing aid.

39. The apparatus according to claim 24, wherein a combined length of the first and second segments of the antenna is a quarter of a wavelength or larger.

40. The apparatus according to claim 24, further comprising an elongated member for wear around a neck of the user.

41. The apparatus according to claim 40, wherein when the user wears the elongated member around the neck, the housing rests against a body of the user.

42. The apparatus according to claim 24, wherein the housing has a major surface.

43. The apparatus according to claim 24, wherein the second segment has an end that is free of electrical connection to its surrounding.

44. The apparatus according to claim 24, wherein the apparatus is a hearing aid, and wherein at least a part of the antenna is oriented in a direction that corresponds with an ear-to-ear axis of the user.

45. The apparatus according to claim 24, wherein the electric field is polarized in the direction such that a propagation loss in tissue of the user is less than a certain level.

* * * * *